United States Patent [19]

Martens et al.

[11] Patent Number: 5,071,362

[45] Date of Patent: Dec. 10, 1991

[54] SELF-OPERATIVE ELECTRICAL SHUNTING CONTACT AND METHOD FOR FORMING

[75] Inventors: Mark D. Martens, Toledo, Ohio; Jerry A. Kendall, Lewisville, Tex.

[73] Assignee: Augat Inc., Mansfield, Mass.

[21] Appl. No.: 596,244

[22] Filed: Oct. 12, 1990

[51] Int. Cl.[5] ..... H01B 29/00

[52] U.S. Cl. ..... 439/188; 29/874; 29/885; 200/51.10; 439/510; 439/513

[58] Field of Search ..... 29/872, 874, 884, 885; 200/51.09, 51.10; 439/188, 510–513

[56] References Cited

U.S. PATENT DOCUMENTS

| | | | |
|---|---|---|---|
| 2,312,002 | 2/1943 | Schmitt | 200/51.1 |
| 4,070,557 | 1/1978 | Ostapovitch | 439/513 |
| 4,152,041 | 5/1979 | Hollyday et al. | 439/188 |
| 4,352,534 | 10/1982 | Johnson | 439/510 |
| 4,588,240 | 5/1986 | Ruehl et al. | 439/513 |
| 4,795,602 | 1/1989 | Pretchel et al. | 439/510 |
| 4,909,744 | 3/1990 | Muto | 439/513 |

*Primary Examiner*—Paula A. Bradley
*Attorney, Agent, or Firm*—Weingarten, Schurgin, Gagnebin & Hayes

[57] ABSTRACT

An electrical shunting contact and method for producing the same for mounting between adjacent first contacts in a first connector and for self-operatively providing a short circuit between the adjacent first electrical contacts when corresponding second contacts of a second connector are demated from the first connector. The electrical shunting contact comprises a conductive member having opposing legs joined by a resilient bridge, each leg having a non-conductive protuberance projecting outwardly therefrom. Under demated conditions, a contact edge of each leg abuts the adjacent first contacts between which the shunting contact is mounted to form a short circuit therebetween and the non-conductive protuberance is disposed in a chamber located just above the first contact. The presence of a second contact forces the legs of the shunting contact to be compressed out of engagement with the first contacts, thereby creating an open circuit between the adjacent first contacts.

12 Claims, 3 Drawing Sheets

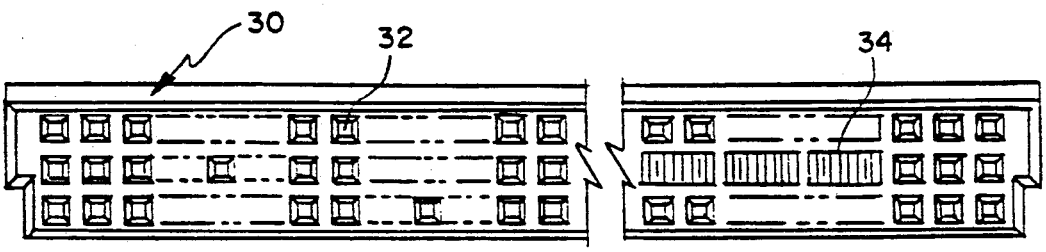
Fig 3
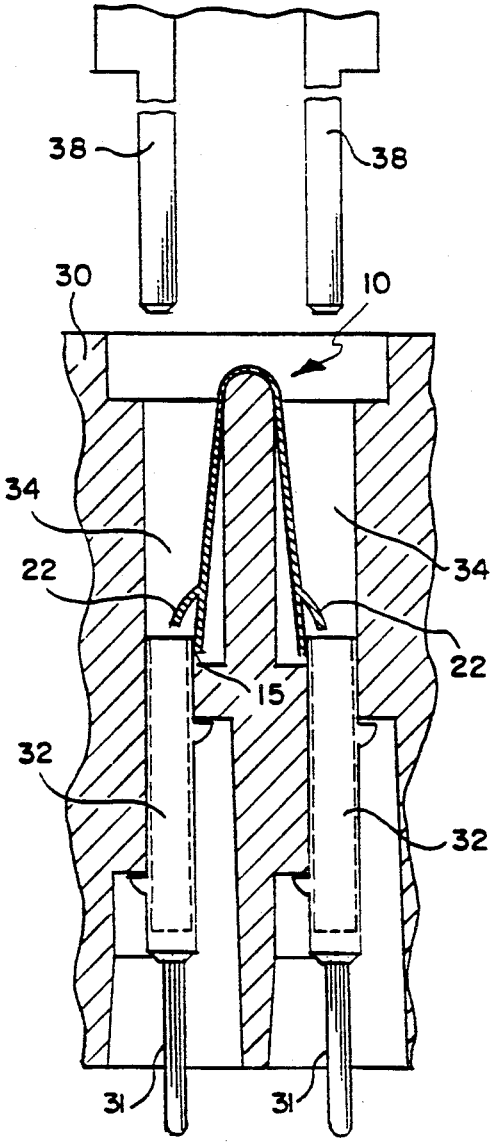
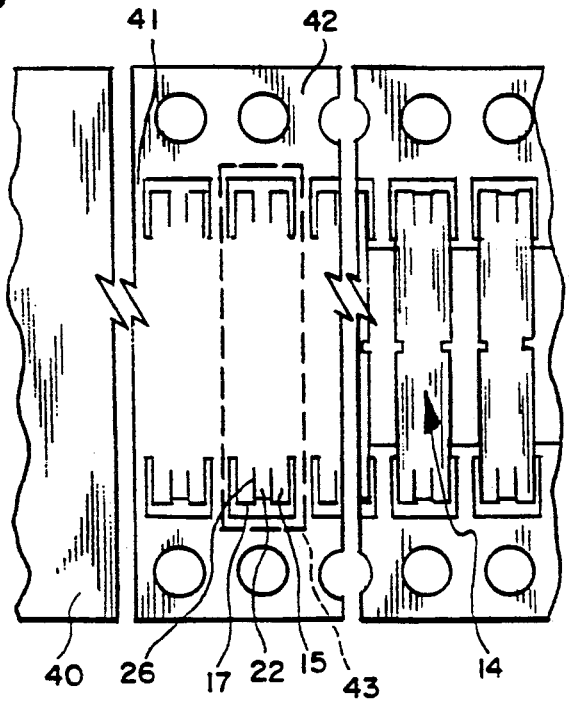
Fig 5
Fig 4

SELF-OPERATIVE ELECTRICAL SHUNTING CONTACT AND METHOD FOR FORMING

FIELD OF THE INVENTION

This invention relates generally to electrical contacts and more specifically, to a self-operative electrical shunting contact and method for forming the same.

BACKGROUND OF THE INVENTION

Electrical connectors in which a first connector comprising an array of first electrical contacts is joined to a corresponding second connector comprising an array of second electrical contacts are well known in the electronics industry for providing reliable interfacing between components. One type of connector, known as a backplane connector, has been used extensively in computers for connecting printed circuit boards or daughterboards to a computer backplane or motherboard. It is often necessary to separate these connectors to remove a particular daughterboard from a motherboard in order to replace a board or to perform repairs or to conduct troubleshooting. Given this need, it is often desirable to short circuit certain leads on a motherboard when a daughterboard is removed in order for the system to continue operation despite the absence of that particular daughterboard.

In the past, the typical approach for shorting contact points on a motherboard involved a crude manual approach in which wires having attachable ends were used to make connections between discrete points on the motherboard to form the desired short circuit. This approach is time consuming and often results in creating a short circuit between incorrect contact points due to technician error. Thus, it is desirable to provide a self-operative shunting contact on a connector to create specific electrical paths when a daughterboard is removed from a motherboard. The benefit of such self-shunting contacts has been recognized in other areas of electrical connectors such as coaxial connectors as shown in U.S. Pat. No. 4,660,921.

SUMMARY OF THE INVENTION

The present invention discloses an electrical shunting contact and method for fabricating such contact wherein the contact is mounted in a female connector and which self-operatively creates a short circuit between adjacent contacts located in the female connector when the female connector and its corresponding male connector are separated from one another. Thus, in accordance with the present invention, automatic shunting is accomplished between adjacent female contacts in the absence of male contacts. This result is useful in a configuration in which it is desirable to create certain signal paths between contacts when connectors are demated, as in a computer backplane.

The electrical shunting contact of the present invention comprises an electrically conductive member having at least two opposing legs joined by a resilient bridge, each leg having at least one contact edge located along the foot of the leg, as well as a non-conductive protuberance projecting outwardly from the surface of the leg. The electrical shunting contact is inserted into a female connector containing an array of female contacts such that the legs of the electrical shunting contact are constrained between two adjacent female contacts, permitting the contact edges of the legs to abut the exterior surface of the adjacent female contacts, thereby creating an electrical path between the adjacent female contacts.

In this configuration, the non-conductive protuberance extends into and is disposed in a chamber just above the entrance to the female contact. Thus, when a male contact is inserted into the female contact, the leading edge of the male contact exerts a force on the protuberance, pushing the protuberance laterally away from the chamber. This force compresses the leg of the connector, breaking the electrical connection between the contact edge of the electrical shunting contact and the female contact and creating an open circuit between the adjacent female contacts.

The present invention is a passive and self-operative device. The electrical shunting contact is mounted into the female connector and is operative to produce an electrical contact between adjacent contacts only when the male connector and the female connector are demated. The electrical shunting contact has no effect when the male and female connectors are mated, as in normal use.

DESCRIPTION OF THE DRAWINGS

The invention will be more fully understood from the following detailed description taken in conjunction with the accompanying drawings, in which:

FIG. 3 is a top view of a female box connector into which the electrical shunting contact of the present invention is to be mounted;

FIG. 4 is a vertical cut-away view of the electrical shunting contact of the present invention as mounted within the female box connector of FIG. 3; and FIG. 5 is a plan view illustrating a strip of electrical shunting contacts of the present invention at various steps of fabrication.

DETAILED DESCRIPTION OF THE INVENTION

Figure 1A:
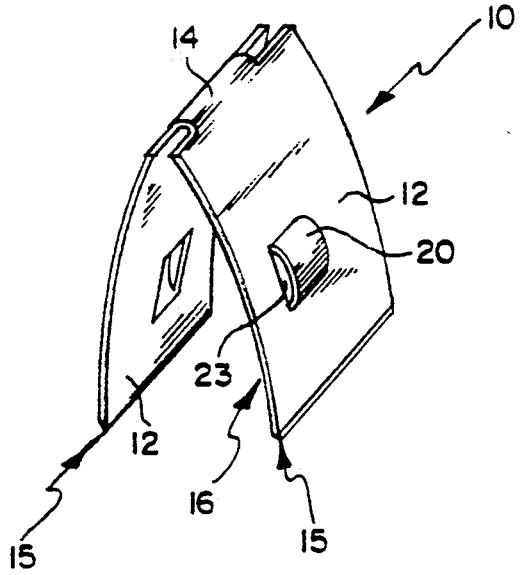
FIGS. 1A–1C are perspective views of alternative embodiments of the electrical shunting contact according to the present invention.
Figure 1B:
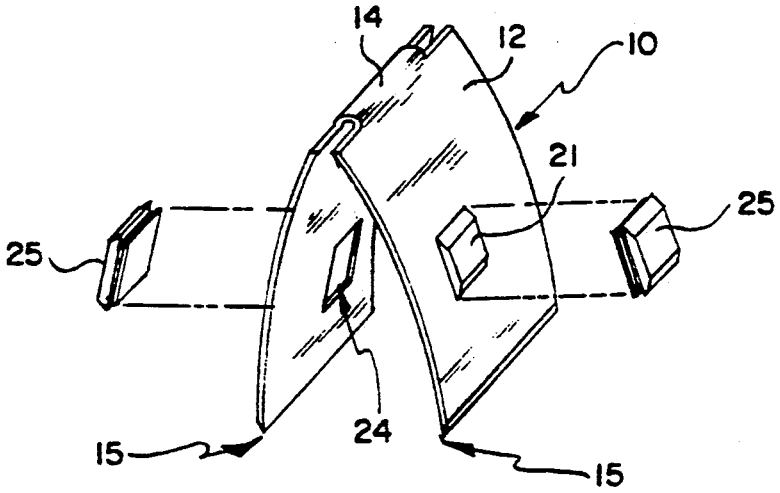
Figure 1C:
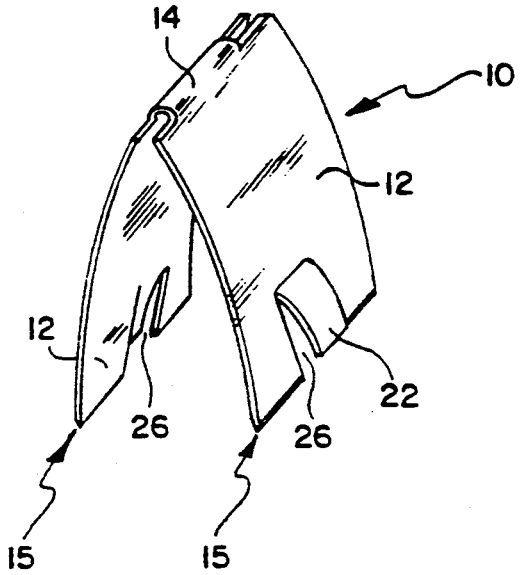

FIGS. 1A–1C illustrate three embodiments of an electrical shunting contact 10 comprises a thin member of electrically conductive material formed into a U-shape having two opposed legs 12 joined by a resilient bridge 14, wherein each leg 12 includes at least one contact edge 15 located along the foot 16 and a non-conductive protuberance 20, 21, 22, respectively.

In the embodiment of FIG. 1A, the non-conductive protuberance 20, is formed by cutting a pair of parallel slits 23 in each leg during the manufacturing process, wherein the material between the slits 23 is pressed outward from the leg 12. This formed protuberance is then coated with a layer of non-conductive material as, for example, an epoxy resin. In another embodiment of the invention, as shown in FIG. 1B, the protuberance 21 is provided by creating a substantially rectangular throughhole 24 in the body of the electrical contact into which a preformed plug 25, made from a flexible non-conductive material, is inserted to function as the non-conductive protuberance 21. In yet another embodiment of the invention, illustrated in FIG. 1C, the protuberance 22 is formed by stamping slits 26 in the foot of each leg 12 of the electrical shunting contact 10 where the material between the slits 26 is pressed outward and the protuberance is coated with some non-conductive material such as an epoxy resin.

In order to make the present disclosure more understandable, the present invention will be described in detail in terms of the embodiment of FIG 1C only. However, it is to be understood that the present invention contemplates an electrical shunting contact by way of any and all of the above described embodiments.

Figure 2B:
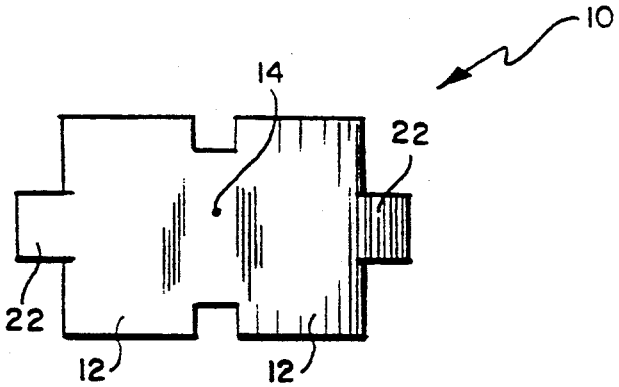
FIGS. 2A–2C are front, top and side views, respectively, of the embodiment of FIG. 1C of the present invention.
Figure 2C:
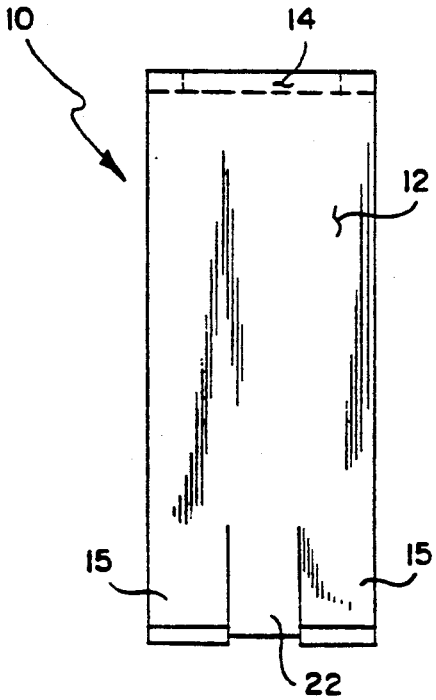
Figure 2A:
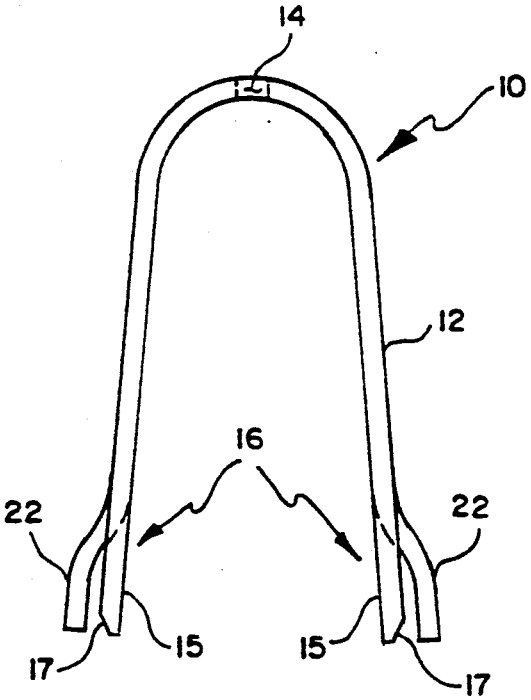

Referring now to the more detailed drawings of FIGS. 2A-2C, there are shown: front; top; and side views, respectively, of an electrical shunting contact 10 of the present invention comprising a U-shaped member having symmetrical legs 12 opposite one another joined by a resilient bridge 14. Each leg 12 includes a conductive contact edge 15 defined by a chamfer 17 located along the edge of the foot 16 of the leg 12, and a non-conductive protuberance 22 extending outwardly from the surface of the foot 16. The body is fabricated from a suitably resilient conductive material such that the legs 12 of the electrical shunting contact 10 are compressed toward one another when subjected to lateral forces.

FIGS. 3 and 4 show a female box connector 30 with an array of female contacts 32 mounted in contact cavities 31 thereof. The electrical shunting contact 10 of the present invention is mounted between two adjacent female contacts 32.

When male contacts 38 are demated from the female connector 30, as in FIG. 4, the electrical shunting contact 10 is resiliently biased in a configuration which allows conductive contact edges 15 of the electrical shunting contact 10 to form an electrical connection between adjacent female contacts 32 and with the non-conductive protuberance 22 residing in the chamber 34 just above the female contacts 32. Conversely, when male contacts 38 are mated with the female connector 30 such that the male contacts 38 are disposed within corresponding female contacts 32, the male contacts 38 exert force against the respective protuberances 22 of the electrical shunting contact 10, forcing the legs 12 laterally inward and out of engagement with the female contacts 32, thereby breaking the electrical connection between the electrical shunting contact 10 and the female contacts 32.

The fabrication of the exemplary contact of FIG. 1C and FIGS. 2A-2C, is illustrated in FIG. 5. The contact is fabricated by passing a flat strip 40 of metal through a conventional progressive punch and die apparatus and by applying conductive and non-conductive material appropriately, using known techniques.

The electrical shunting contacts 10 are formed on a dual carrier strip 42 joined to each contact at a point 41 where the electrical shunting contacts 10 will be separated from the carrier strip 42. In the first step of the manufacturing process, metal is removed from the strip 40, slits 26 are punched and a chamfer 17 is formed to stamp out a blank 43 of the contact which defines contact edges 15 and a stamped protuberance 22. Each blank 43 is then plated at each end with a layer of highly conductive material such as gold, at the contact edge 15, and a layer of insulation, such as epoxy, is then applied to the non-conductive protuberance 22 by any known technique. The plated blank 43 is then stamped again to form the bridge 14 and finally formed into a U-shaped contact 10.

Alternatively, the first step of the manufacturing process described above involves punching a throughhole 24 in each leg, in lieu of punching slits 26. This step is then followed by the insertion of a preformed plug 25 into each punched throughhole 24. Finally, the preformed plug 25 may or may not be coated with a layer of insulation depending on the electrical conductivity of the material forming the plug 25 to provide the electrical shunting connector shown in FIG. 1B.

A variety of modifications and variations of the present method and apparatus are possible in light of the teachings set forth above. In particular, the present invention is not limited to backplane connectors but can be any electrical connector for providing a short circuit when the connector is demated or unplugged. Therefore, it is to be understood that the present invention is to be viewed as embracing each and every novel feature and novel combination of features present in, or possessed by the invention disclosed herein, to be limited solely by, the scope and spirit of the appended claims.

What is claimed is:

1. An electrical shunting contact for mounting in a first electrical connector between selected adjacent first contacts thereof, wherein a short circuit is created between the selected adjacent first contacts with the selected adjacent first contacts demated from second contacts of a corresponding second electrical connector, and further wherein an open circuit is created between the selected adjacent first contacts with the selected adjacent first contacts mated to the second contacts, said electrical shunting contact comprising:

a conductive member having at least two opposing legs and a resilient bridge joining said at least two opposing legs wherein said at least two opposing legs include a foot segment, a non-conductive protuberance projecting outwardly from said foot segment, and a conductive contact edge along the base of said foot segment for forming an electrical contact between the selected adjacent first contacts, and further wherein said resilient bridge is operative to bias said at least two opposing legs outwardly from one another to create the short circuit between the selected adjacent first contacts with the selected adjacent first contacts demated from the second contacts, and to create the open circuit between the selected adjacent first contacts with the selected adjacent first contacts mated to the second contacts.

2. The electrical shunting contact of claim 1 wherein: said non-conductive protuberance is integrally formed as part of said foot segment.

3. The electrical shunting contact of claim 1 wherein: said non-conductive protuberance is integrally formed as part of the base of said foot segment.

4. The electrical shunting contact of claim 1 wherein: said non-conductive protuberance is a preformed plug mounted on said foot segment.

5. The electrical shunting contact of claim 1 wherein: said non-conductive protuberance is coated with an insulative material.

6. The electrical shunting contact of claim 5 wherein: said insulative material is an epoxy resin.

7. The electrical shunting contact of claim 1 wherein: said conductive contact edge comprises a chamfer along the outside border to provide a greater surface area of electrical contact between said conductive contact edge and said adjacent first contact.

8. The electrical shunting contact of claim 1 wherein: said conductive contact edge is plated with a highly conductive material to provide greater conductivity between said conductive contact edge and said adjacent first contacts.

9. The electrical shunting contact of claim 8 wherein: said highly conductive material is gold.

10. A self-shunting electrical connector having a plurality of first electrical contacts configured for mating with a second electrical connector having a plurality of second electrical contacts, said self-shunting electrical connector comprising:

a housing of insulative material having a plurality of contact cavities, wherein each said contact cavity houses a first electrical contact and further wherein selected ones of said plurality of contact cavities include a chamber in adjacent relationship thereto, said chamber defining at least one pair of selected adjacent first electrical contacts;

at least one electrical shunting contact mounted in said chamber between at least one pair of selected adjacent first electrical contacts, said at least one electrical shunting contact including a conductive member having at least two opposing legs and a resilient bridge for joining said at least two legs wherein said at least two opposing legs include a foot segment, a non-conductive protuberance projecting outwardly from said at least two legs, and a conductive contact edge along the base of said foot segment for forming an electrical contact between said selected adjacent first electrical contacts, and further wherein said resilient bridge is operative to bias said at least two opposing legs outwardly from one another to create a short circuit between said selected adjacent first electrical contacts with said self-shunting electrical connector demated from the second electrical connector and further to create an open circuit between said selected adjacent first electrical contacts with said self-shunting contact mated to the second electrical contact.

11. A method of fabricating an electrical shunting contact for mounting in a first electrical connector between selected adjacent first contacts thereof, wherein a short circuit is created between the selected adjacent first contacts with the selected adjacent first contacts demated from second contacts of a corresponding second electrical connector, and further wherein an open circuit is created between the selected adjacent first contacts with the selected adjacent first contacts mated to the second contacts, said method of fabricating comprising the steps of:

removing material from a metallic carrier strip to form a plurality of blanks of said electrical shunting contact, each said blank having at least two legs;

forming a contact edge along each of said at least two legs;

stamping each said plurality of blanks of said electrical shunting contact to form a protuberance on each said at least two legs;

plating each said contact edge with a layer of highly conductive material;

coating each said protuberance with a layer of insulative material;

stamping each said plurality of blanks of said electrical shunting contact to form a bridge between said at least two legs; and forming each of said plurality of blanks into said electrical shunting contact having said at least two legs opposing one another, joined by said bridge.

12. A method of fabricating an electrical shunting contact for mounting in a first electrical connector between selected adjacent first contacts thereof, wherein a short circuit is created between the selected adjacent first contacts with the selected adjacent first contacts demated from second contacts of a corresponding second electrical connector, and further wherein an open circuit is created between the selected adjacent first contacts with the selected adjacent first contacts mated to the second contacts, said method of fabricating comprising the steps of:

removing material from a metallic carrier strip to form a plurality of blanks of said electrical shunting contact, each said blank having at least two legs;

forming a contact edge along each of said at least two legs;

stamping each said plurality of blanks of said electrical shunting contact to form a throughhole on each said at least two legs;

mounting a preformed plug into each said throughhole;

plating each said contact edge with a layer of highly conductive material;

coating each said protuberance with a layer of insulative material;

stamping each said plurality of blanks of said electrical shunting contact to form a bridge between said at least two legs, and;

forming each of said plurality of blanks into said electrical shunting contact having said at least two legs opposing one another, joined by said resilient bridge.

* * * * *

UNITED STATES PATENT AND TRADEMARK OFFICE

CERTIFICATE OF CORRECTION

PATENT NO. : 5,071,362

DATED : December 10, 1991

INVENTOR(S) : Mark D. Martens, et al.

It is certified that error appears in the above-identified patent and that said Letters Patent is hereby corrected as shown below:

Column 2, line 47, "contact 10" should read --contact of the present invention. The electrical shunting contact 10--.

Signed and Sealed this

Ninth Day of November, 1993

Bruce Lehman

*Attest:*

BRUCE LEHMAN

*Attesting Officer*

*Commissioner of Patents and Trademarks*